US007956829B2

(12) United States Patent
Iida et al.

(10) Patent No.: US 7,956,829 B2
(45) Date of Patent: Jun. 7, 2011

(54) DISPLAY APPARATUS

(75) Inventors: Yukihito Iida, Kanagawa (JP); Masatsugu Tomida, Kanagawa (JP); Takao Tanikame, Kanagawa (JP); Katsuhide Uchino, Kanagawa (JP)

(73) Assignee: Sony Corporation, Tokyo (JP)

( * ) Notice: Subject to any disclaimer, the term of this patent is extended or adjusted under 35 U.S.C. 154(b) by 855 days.

(21) Appl. No.: 11/979,653

(22) Filed: Nov. 7, 2007

(65) Prior Publication Data

US 2008/0129660 A1 Jun. 5, 2008

(30) Foreign Application Priority Data

Dec. 1, 2006 (JP) ..... 2006-325089

(51) Int. Cl.
*G09G 3/32* (2006.01)

(52) U.S. Cl. ..... 345/80; 345/82

(58) Field of Classification Search ..... 345/80, 345/82, 76; 315/169

See application file for complete search history.

(56) References Cited

U.S. PATENT DOCUMENTS

| | | | | |
|---|---|---|---|---|
| 7,042,162 | B2 * | 5/2006 | Yamazaki et al. | 315/169.1 |
| 7,129,938 | B2 * | 10/2006 | Naugler, Jr. | 345/207 |
| 7,173,586 | B2 * | 2/2007 | Osame et al. | 345/82 |
| 7,176,857 | B2 * | 2/2007 | Osame et al. | 345/76 |

FOREIGN PATENT DOCUMENTS

| | | |
|---|---|---|
| JP | 2003-255856 | 9/2003 |
| JP | 2003-271095 | 9/2003 |
| JP | 2004-029791 | 1/2004 |
| JP | 2004-093682 | 3/2004 |
| JP | 2004-133240 | 4/2004 |

* cited by examiner

*Primary Examiner* — Quan-Zhen Wang
*Assistant Examiner* — Sepideh Ghafari
(74) *Attorney, Agent, or Firm* — Rader, Fishman & Grauer PLLC

(57) ABSTRACT

Disclosed herein is a display apparatus includes, a pixel array and a driver configured to drive the pixel array. The pixel array includes rows of scanning lines, columns of signal lines, a matrix of pixels disposed at crossings of the scanning lines and the signal lines, and feeding lines associated with respective rows of the pixels, the pixels including respective sampling transistors having respective gates connected to the scanning lines; and the driver includes a main scanner configured to supply control signals to the scanning lines, the main scanner including a shift register, output buffers connected respectively between the shift register and the scanning lines, and a pulse power supply configured to supply power supply pulses, each having a predetermined pulse duration, to the output buffers, and wherein the main scanner outputs power supply pulses supplied from the pulse power supply as the control signals to the respective scanning lines in response to a shift pulse output from the shift register.

6 Claims, 13 Drawing Sheets

DISPLAY APPARATUS

CROSS REFERENCES TO RELATED APPLICATIONS

The present invention contains subject matter related to Japanese Patent Application JP 2006-325089 filed in the Japan Patent Office on Dec. 1, 2006, the entire contents of which are incorporated herein by reference.

BACKGROUND OF THE INVENTION

1. Field of the Invention

The present invention relates to a display apparatus of the active matrix type including light-emitting elements as pixels.

2. Description of the Related Art

In recent years, growing efforts have been made to develop a planar self-emission display apparatus including organic EL devices as light-emitting elements. The organic EL device is a device which utilizes the phenomenon of light emission from an organic thin film that is placed under an electric field. The organic EL device is of a low power requirement, as it can be energized under an applied voltage of 10 V or lower. Furthermore, the organic EL device is a self-emission device capable of emitting light by itself; it needs no illuminating members and can easily be reduced in weight and thickness. The organic EL device produces no image persistence when displaying moving images because it has a very high response rate of about several μs.

Particular efforts have been made to develop an active matrix display apparatus including integrated thin-film transistors as pixels among the planar self-emission display apparatuses including organic EL devices as light-emitting elements. Active matrix, planar, self-emission display apparatuses are, for example, disclosed in: Japanese Patent Laid-open No. 2003-255856; Japanese Patent Laid-open No. 2003-271095; Japanese Patent Laid-open No. 2004-133240; Japanese Patent Laid-open No. 2004-029791; and Japanese Patent Laid-open No. 2004-093682.

SUMMARY OF THE INVENTION

However, the active matrix, planar, self-emission display apparatuses of the related art are disadvantageous in that transistors for driving the light-emitting elements suffer from threshold voltage and mobility variations due to fabrication process fluctuations. In addition, the organic EL devices have characteristics tending to vary with time. Such characteristic variations of the driving transistors and characteristic fluctuations of the organic EL devices adversely affect the light emission luminance. For setting the light emission luminance to a uniform level over the entire display surface of the display apparatus, it is necessary to correct the characteristic fluctuations of the transistors and the organic EL devices in respective pixel circuits. There have heretofore been proposed display apparatus having such a characteristic fluctuation correcting function in each pixel. However, pixel circuits of the related art which have the characteristic fluctuation correcting function are complex in structure as they need interconnects for supplying a correcting potential, switching transistors, and switching pulses. Since the pixel circuits are made up of many components, they have presented an obstacle to a high-definition display capability.

According to an embodiment of the present invention, it is desirable to provide a display apparatus which has a high-definition display capability achieved by simplified pixel circuits.

Further, according to an embodiment of the present invention, it is also desirable to provide a display apparatus which increases the accuracy of control signals supplied to transistors included in pixel circuits for reliably sampling video signals supplied to pixels and reliably performing correcting functions of pixels.

According to an embodiment of the present invention, a display apparatus includes a pixel array and a driver configured to drive the pixel array. The pixel array includes rows of scanning lines, columns of signal lines, a matrix of pixels disposed at crossings of the scanning lines and the signal lines, and feeding lines associated with respective rows of the pixels. The driver includes a main scanner configured to scan the rows of the pixels in a line sequential mode by supplying a control signal successively to the scanning lines, a power supply scanner configured to supply a power supply voltage, which switches between a first potential and a second potential, to the feeding lines in timed relation to the line sequential mode, and a signal selector configured to selectively supply a signal potential serving as a video signal and a reference potential to the columns of the signal lines in the line sequential mode. Each of the pixels includes a light-emitting element, a sampling transistor, a driving transistor, and a retentive capacitor. The sampling transistor has a gate connected to one of the scanning lines, and a source and a drain, one of which is connected to one of the signal lines and the other is connected to the gate of the driving transistor. The driving transistor has a source and a drain, one of which is connected to the light-emitting element and the other is connected to one of the feeding lines. The retentive capacitor is connected between the source and the gate of the driving transistor. The sampling transistor is rendered conductive in response to a control signal supplied from the scanning line, sampling the signal potential supplied from the signal line and holding the sample signal potential in the retentive capacitor. The driving transistor supplies a drive current to the light-emitting element depending on the signal potential held in the retentive capacitor in response to a current supplied from the feeding line which is under the first potential. In order to render the sampling transistor conductive in a time interval in which the signal line is under the signal potential, the main scanner outputs a control signal having a predetermined pulse duration to the scanning line, thereby holding the signal potential in the retentive capacitor, and simultaneously applies a correction for the mobility of the driving transistor to the signal potential. The main scanner includes a shift register, output buffers connected between respective stages of the shift register and the scanning lines, and a pulse power supply configured to supply a train of power supply pulses, each having a predetermined pulse duration, to the output buffers. The shift register outputs shift pulses successively from the respective stages in timing relation to the line sequential mode. The output buffers operate in response to the shift pulses output from the corresponding stages of the shift register to output power supply pulses supplied from the pulse power supply as control signals to the corresponding scanning lines.

According to another embodiment of the present invention, each of the output buffers may include an inverter including a pair of complementary switching devices connected in series between a power supply line and a ground line, and the pulse power supply may supply a train of power supply pulses to the power supply line of the inverter. At least one of the switching devices which is closer to the power supply line may include a transmission gate device. When a signal potential is held in the retentive capacitor, the main scanner may render the sampling transistor conductive to electrically disconnect the gate of the driving transistor from the signal line, thereby allowing the gate potential of the driving transistor to vary as the source potential thereof varies, and thereby keeping the voltage between the gate and the source of the driving transistor constant. The power supply scanner may switch the feeding lines from the second potential to the first potential at a first timing before the sampling transistor samples the signal potential. The main scanner may render the sampling transistor conductive to apply a reference potential from the signal line to the gate of the driving transistor and set the source of the driving transistor to the second potential at a second timing before the sampling transistor samples the signal potential. The power supply scanner may switch the feeding line from the second potential to the first potential to hold a voltage corresponding to the threshold voltage of the driving transistor in the retentive capacitor at a third timing after the second timing.

According to an embodiment of the present invention, in an active matrix display apparatus wherein light-emitting elements such as organic EL devices are used as pixels, each of the pixels has a function to correct the mobility of the driving transistor, and also preferably has a function to correct the threshold voltage of the driving transistor and a function to correct aging-based variations of the organic EL device (bootstrapping operation) for displaying images of high quality. Heretofore, the pixels with those correcting functions were not suitable for realizing a high-definition display capability due to a large layout area of pixels because the number of components making up the pixels is large. According to the embodiment of the present invention, since the power supply voltage is supplied as switching pulses, the number of components making up the pixels and the number of interconnects used are reduced to reduce the layout area of the pixels. The display apparatus thus can be provided as a high-quality, high-definition flat display.

According to an embodiment of the present invention, in order to render the sampling transistor conductive in a time interval during which the signal line is under the signal potential, the main scanner outputs a control signal having a predetermined pulse duration to the scanning line, thereby holding the signal potential in the retentive capacitor, and simultaneously applies a correction for the mobility of the driving transistor to the signal potential. At this time, the main scanner outputs a power supply pulse having a predetermined pulse duration that is supplied from the pulse power supply as a control signal to the scanning line. Stated otherwise, the main scanner extracts power supply pulses for the respective scanning lines from the train of pulses supplied from the pulse power supply and outputs the extracted power supply pulses as control signals to the corresponding scanning lines. The control signals applied to the gates of the sampling transistors are the power supply pulses, and they have accurate pulse waveforms. Since the power supply pulses supplied from the pulse power supply are extracted and supplied to the respective scanning lines, any variations of the control signals between the scanning lines for performing a stable sampling process and a stable mobility correcting process are small. The sampled signal potentials do not suffer variations, and there is no danger of luminance irregularities. As a consequence, the display apparatus is capable of displaying images having a good image equality.

The above and other embodiments, features, and advantages of the present invention will become apparent from the following description when taken in conjunction with the accompanying drawings which illustrate a preferred embodiment of the present invention by way of example.

DETAILED DESCRIPTION OF THE PREFERRED EMBODIMENTS

Figure 1A:
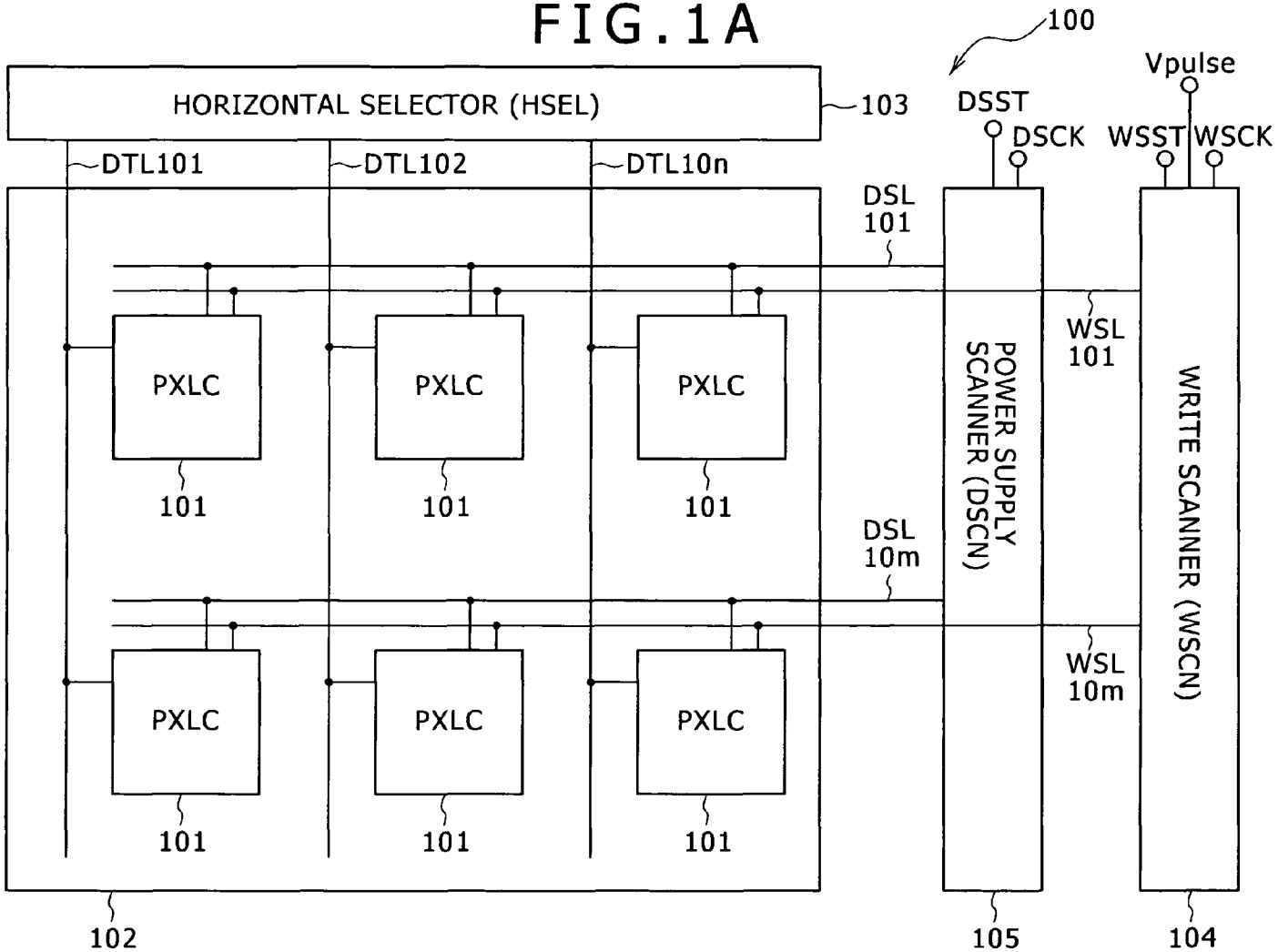
FIG. 1A is a block diagram of a display apparatus according to an embodiment of the present invention.

A display apparatus according to embodiments of the present invention will be described in detail below with reference to the drawings. FIG. 1A shows in block form the display apparatus according to the embodiment of the present invention. As shown in FIG. 1A, the display apparatus, generally designated by 100, includes a pixel array 102 and a driver (103, 104, 105) for driving the pixel array 102. The pixel array 102 includes rows of scanning lines WSL101 through WSL10*m*, columns of signal lines DTL101 through DTL10*n*, a matrix of pixels (PXLC) 101 disposed at crossings of the scanning lines WSL101 through WSL10*m* and the signal lines DTL101 through DTL10*n*, and feeding lines DSL101 through DSL10*m* associated with respective rows of the pixels 101. The driver includes a main scanner (write scanner WSCN) 104 for scanning the rows of the pixels 101 in a line sequential mode by supplying a control signal successively to the scanning lines WSL101 through WSL10*m*, a power supply scanner (DSCN) 105 for supplying a power supply voltage, which switches between a first potential and a second potential, to the feeding lines DSL101 through DSL10*m* in timed relation to the line sequential mode, and a signal selector (horizontal selector HSEL) 103 for selectively supplying a signal potential serving as a video signal and a reference potential to the columns of the signal lines DTL101 through DTL10*m* in the line sequential mode.

The write scanner 104 includes a shift register. In response to a clock signal WSCK supplied from an external source, the shift register operates to generate shift pulses which serve as a basis for control signals by successively shifting a start pulse WSST that is also supplied from an external source. The write scanner 104 is supplied with power supply pulses Vpulse from a pulse power supply. The write scanner 104 outputs control signals to the scanning line WSL by processing the power supply pulses Vpulse with the shift pulses. The power supply scanner 105 also includes a shift register. In response to a clock signal DSCK supplied from an external source, the power supply scanner 105 operates to control potential switching on the feeding lines DSL by successively shifting a start pulse DSST supplied from an external source.

Figure 1B:
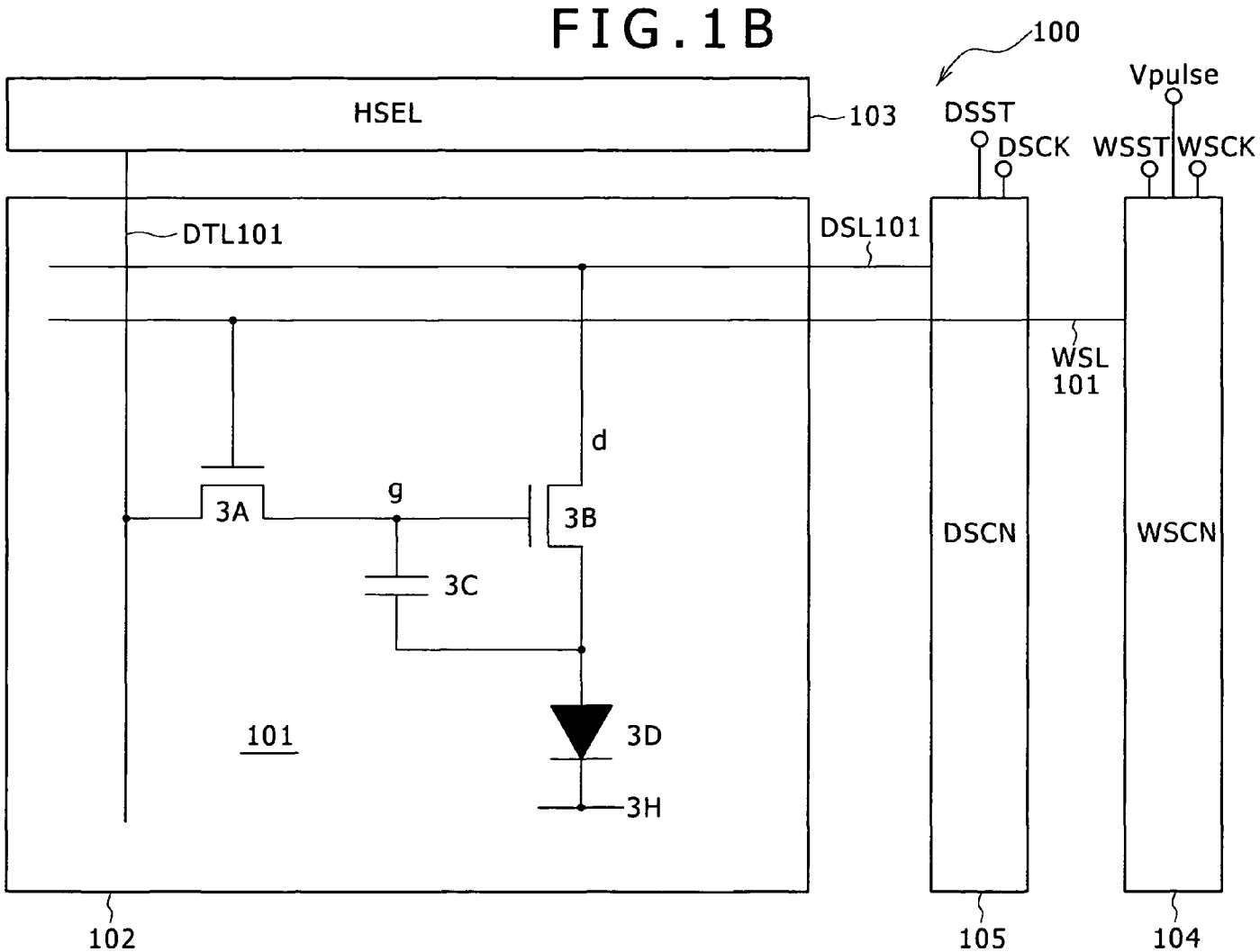
FIG. 1B is a circuit diagram of a pixel circuit included in the display apparatus shown in FIG. 1A.

FIG. 1B is a circuit diagram showing specific structural details and interconnections of each pixel 101 included in the display apparatus 100 shown in FIG. 1A. As shown in FIG. 1B, the pixel 101 includes a light-emitting element 3D, typically including an organic EL device, a sampling transistor 3A, a driving transistor 3B, and a retentive capacitor 3C. The sampling transistor 3A has a gate g connected to the corresponding scanning line WSL101 and a source s and a drain d, one of which is connected to the corresponding signal line DTL101 and the other is connected to the gate g of the driving transistor 3B. The driving transistor 3B has a source s and a drain d, one of which is connected to the light-emitting element 3D and the other is connected to the corresponding feeding line DSL101. According to the illustrated embodiment, the drain d of the driving transistor 3B is a N-channel type and is connected to the feeding line DSL101, and the source s thereof is connected to the anode of the light-emitting element 3D. The cathode of the light-emitting element 3D is connected to a ground interconnect 3H. The ground interconnect 3H is common to all the pixels 101. The retentive capacitor 3C is connected between the source s and gate g of the driving transistor 3B.

The sampling transistor 3A is rendered conductive by a control signal supplied from the scanning line WSL101, sampling the signal potential supplied from the signal line DTL101 and holding the sampled signal potential in the retentive capacitor 3C. When the driving transistor 3B is supplied with a current from the feeding line DSL101 under the first potential (higher potential), the driving transistor 3B supplies a drive current to the light-emitting element 3D depending on the signal potential held by the retentive capacitor 3C. The main scanner (WSCN) 104 outputs a control signal having a predetermined pulse duration to the scanning line WSL101 to hold a signal potential in the retentive capacitor 3C and simultaneously adds a correction for the mobility μ of the driving transistor 3B to the signal potential in order to render the driving transistor 3B conductive during a time interval in which the signal line DTL101 is under the signal potential.

According to the present invention, the write scanner (main scanner) 104 includes the shift register, output buffers disposed between the stages of the shift register and the scanning lines WSL, and the pulse power supply (not shown) for supplying a train of power supply pulses Vpulse each having a predetermined pulse duration to the output buffers. Each of the output buffers operates in response to shift pulses output from the corresponding shift register stage to output a power supply pulse Vpulse supplied from the pulse power supply as a control signal to the corresponding scanning line WSL. Stated otherwise, the control signals supplied to the scanning lines WSL are the power supply pulses Vpulse, which are supplied from the pulse power supply, extracted by the shift pulses output from the shift register. The power supply pulses Vpulse are supplied from the common pulse power supply to the respective stages, and have accurate and stable pulse waveforms. Since the power supply pulses Vpulse are output as the control signals to the respective scanning lines WSL, the control signals are highly accurate and stable. Since the sampling transistors 3A are turned on and off by those control signals, a sampling process and a mobility correcting process are performed accurately and stably.

The pixel circuit 101 shown in FIG. 1B has a threshold voltage correcting function in addition to the mobility correcting function described above. Specifically, before the sampling transistor 3A samples a control potential, the power supply scanner (DSCN) 105 switches the feeding line DSL101 from a first potential (higher potential) to a second potential (lower potential) at a first timing. Before the sampling transistor 3A samples a signal potential, the main scanner (WSCN) 104 renders the sampling transistor 3A conductive at a second timing to apply a reference potential from the signal line DTL101 to the gate g of the driving transistor 3B and sets the source s of the driving transistor 3B to the second potential. Usually, the first timing precedes the second timing. However, the second timing may precede the first timing in some cases. The power supply scanner (DSCN) 105 switches the feeding line DSL101 from the second potential to the first potential at a third timing after the second timing, holding a voltage corresponding to the threshold voltage Vth of the driving transistor 3B in the retentive capacitor 3C. This threshold voltage correcting function makes it possible to cancel the effect of the threshold voltage of the driving transistor 3B which varies from pixel to pixel of the display apparatus 100.

The pixel 101 shown in FIG. 1B also has a bootstrapping function. Specifically, the main scanner (WSCN) 104 cancels the application of the control signal to the scanning line WSL101 when the retentive capacitor 3C holds the signal potential, rendering the sampling transistor 3A nonconductive to electrically disconnect the gate g of the driving transistor 3B from the signal line DTL101. Therefore, the gate potential (Vg) varies as the source potential (Vs) of the driving transistor 3B varies, thereby keeping the voltage Vgs between the gate g and the source s constant.

Figure 2A:
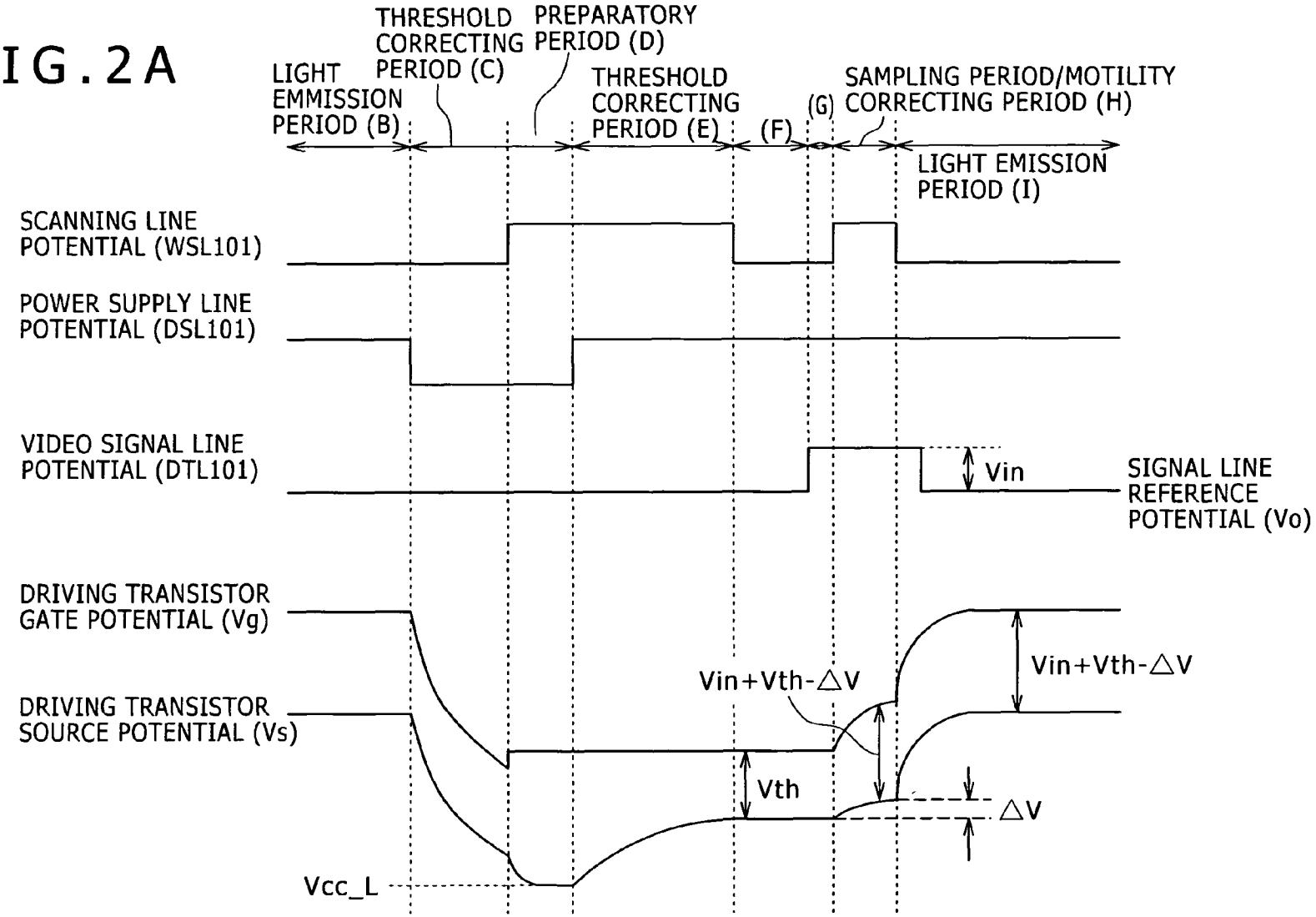
FIGS. 2A to 2I are a timing chart illustrative of operation of the display apparatus according to an embodiment of the present invention.

FIG. 2A is a timing chart illustrative of the operation of the pixel 101 shown in FIG. 1B. The timing chart shows changes in the potential of the scanning line WSL101, the potential of the feeding line DSL101, and the potential of the signal line DTL101 along a common time axis. The timing chart also shows changes in the gate potential (Vg) and the source potential (Vs) of the driving transistor 3B along with the changes of the above potentials.

The timing chart shown in FIG. 2A has its time period divided into periods (B) through (I) along the transition of operation of the pixel 101. In the light emission period (B), the light-emitting element 3D is emitting light. Thereafter, in a new field of the line sequential mode, a power supply line is switched to a lower potential in the first period (C). In the next period (D), the gate potential Vg of the driving transistor and the source potential Vs is reset. By resetting the gate potential Vg and the source potential Vs of the driving transistor 3B in the threshold correcting period (C) and (D), the preparation for the threshold voltage correcting process is set. Next, the threshold voltage correcting process is done in the threshold voltage correcting period (E). Then the voltage corresponding to threshold voltage Vth is held between gate g and source s of the driving transistor 3B. Actually, the voltage corresponding to Vth is written to the retentive capacitor 3C connected between gate g and source s of the driving transistor 3B.

Thereafter, the preparatory periods (F), (G) for the mobility correction are followed by the sampling period/mobility correcting period (H). In the sampling period/mobility correcting period (H), the signal potential Vin of the video signal is written in the retentive capacitor 3C in addition to the threshold voltage Vth, and a voltage ΔV for correcting the mobility is subtracted from the voltage held by the retentive capacitor 3C. In the sampling period/mobility correcting period (H), since the sampling transistor 3A is rendered conductive during a time interval in which the signal line DTL101 is under the signal potential Vin, a control signal having a pulse duration shorter than the time interval is output to the scanning line WSL101, thereby holding the signal potential Vin in the retentive capacitor 3C and simultaneously adding a correction for the mobility μ of the driving transistor 3B to the signal potential Vin.

Thereafter, the light-emitting element emits light at a luminance level dependent on the signal potential Vin in the light emission period (I). Since the signal potential Vin has been adjusted by the voltage corresponding to the threshold voltage Vth and the mobile correcting voltage ΔV, the light emission luminance of the light-emitting element 3D is not affected by variations in the threshold voltage Vth and the mobility μ of the driving transistor 3B. Initially, in the light emission period (I), a bootstrapping process is performed to increase the gate potential Vg and the source potential Vs of the driving transistor 3B while the gate-to-source voltage Vgs (=Vin+Vth−ΔV) of the driving transistor 3B is being maintained constant.

The timing chart shown in FIG. 2A is illustrative of the control signal waveform in which potential changes of the scanning line WSL101 are applied to the gate of the sampling transistor. As can be seen from FIG. 2A, the control signal waveform includes a first pulse output in the threshold correcting period (E) and a second pulse output in the sampling period/mobility correcting period (H). Either one of these pulses is produced by extracting a power supply pulse supplied from the pulse power supply with the output buffer of the write scanner 104.

Figure 2B:
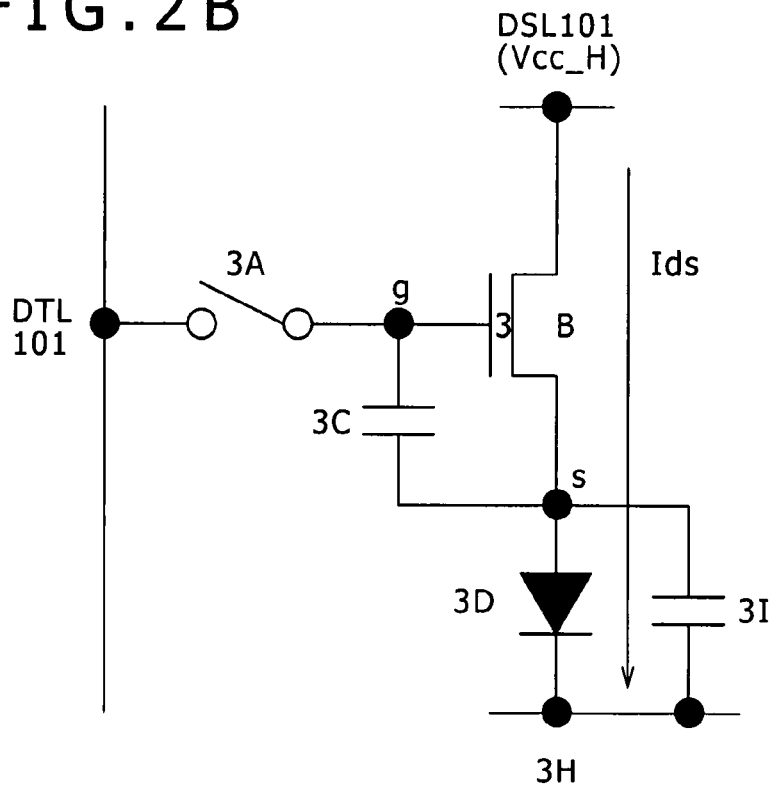

The operation of the pixel 101 shown in FIG. 1B will be described in greater detail with reference to FIGS. 2B through 2I. The suffixes B through L of FIGS. 2B through 2I correspond respectively to the periods (B) through (L) in the timing chart shown in FIG. 2A. For an easier understanding of the operation, the capacitive component of the light-emitting element 3D is illustrated as a capacitor 31 in FIGS. 2B through 2I. As shown in FIG. 2B, during the light emission period (B), the power supply line DSL101 is under the higher potential Vcc_H (first potential), and the driving transistor 3B supplies a drive current Ids to the light-emitting element 3D. As shown in FIG. 2B, the drive current Ids flows from the power supply line DSL101 under the higher potential Vcc_H through the driving transistor 3B and the light-emitting element 3D into the common ground interconnect 3H.

Figure 2C:
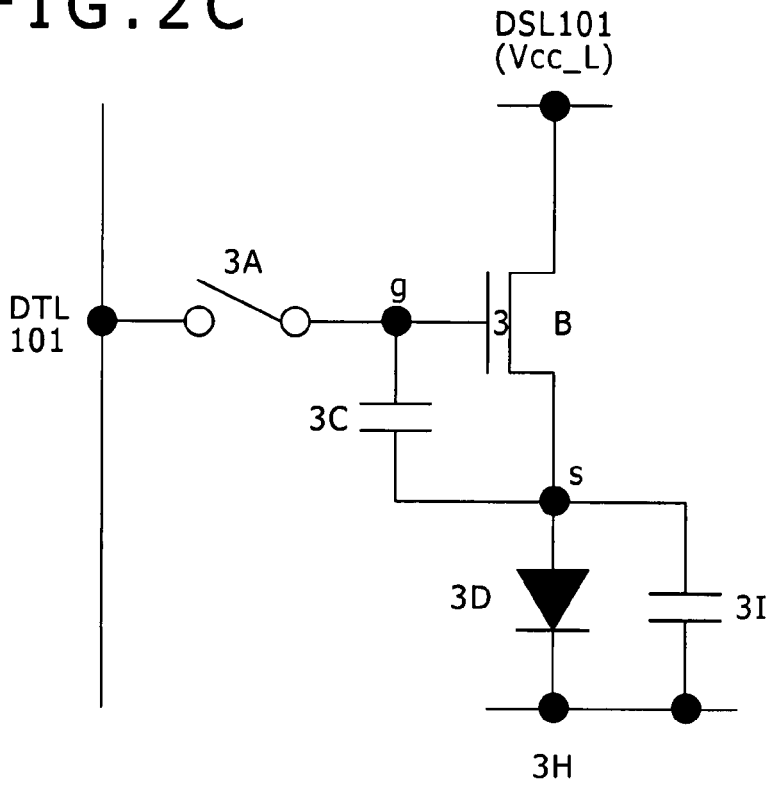

In the period (C), as shown in FIG. 2C, the power supply line DSL101 is controlled to switch from the higher potential Vcc_H to the lower potential Vcc_L. The power supply line DSL101 is discharged to the lower potential Vcc_L, and the source potential Vs of the driving transistor 3B changes to a potential close to the lower potential Vcc_L. If the interconnect capacitance of the power supply line DSL101 is large, then the power supply line DSL101 may be controlled at a relatively early time to switch from the higher potential Vcc_H to the lower potential Vcc_L. The period (C) is set to a sufficiently long period so as to be free from the effects of the interconnect capacitance and the parasitic capacitance of the pixel.

Figure 2D:
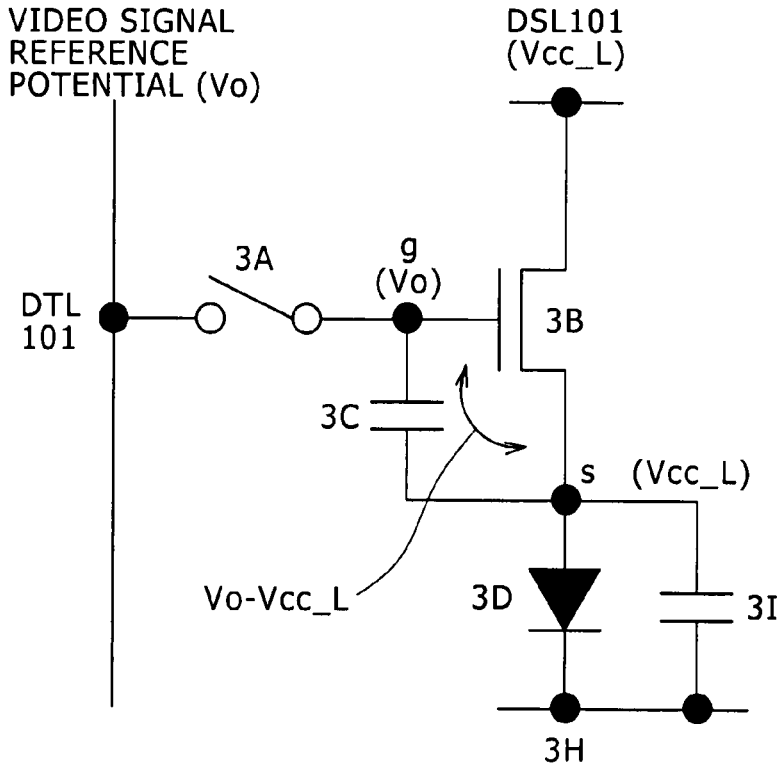

In the period (D), as shown in FIG. 2D, the scanning line WSL101 is controlled to switch from the low level to the high level, rendering the sampling transistor 3A conductive. At this time, the video signal line DTL101 is under the reference potential Vo. The gate potential Vg of the driving transistor 3B is equalized to the reference potential Vo of the video signal line DTL101 through the sampling transistor 3A. At the same time, the source potential Vs of the driving transistor 3B is immediately clamped to the lower potential Vcc_L. The source potential Vs of the driving transistor 3B is thus initialized (reset) to the lower potential Vcc_L, which is sufficiently lower than the reference potential Vo of the video signal line DTL101. Specifically, the lower potential Vcc_L (second potential) of the power supply line DSL101 is set such that the gate-to-source voltage Vgs (the difference between the gate potential Vg and the source potential Vs) of the driving transistor 3B is higher than the threshold voltage Vth of the driving transistor 3B.

Figure 2E:
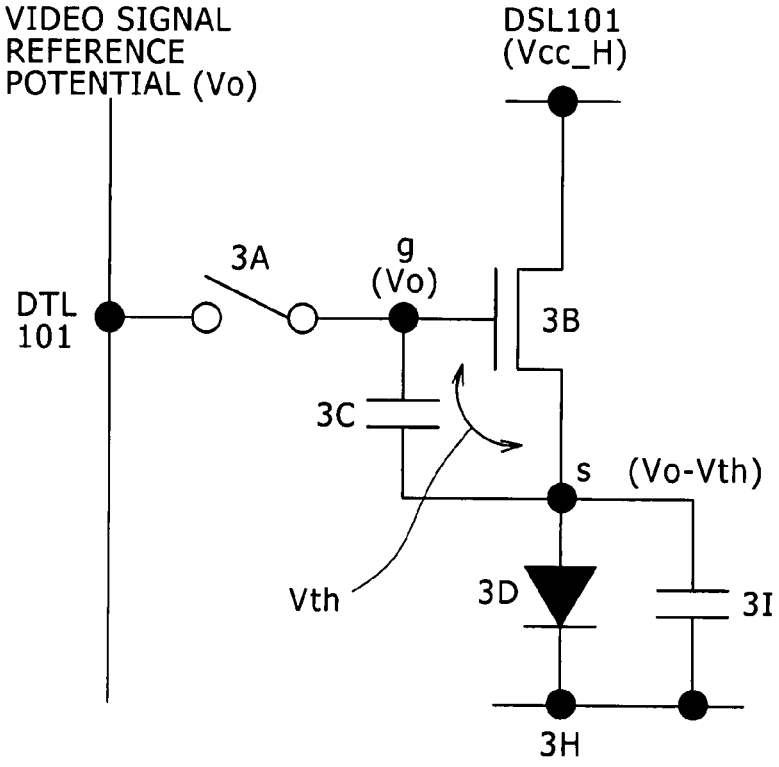

In the threshold voltage period (E), as shown in FIG. 2E, the power supply line DSL101 changes from the lower potential Vcc_L to the higher potential Vcc_H, causing the source potential Vs of the driving transistor 3B to start rising. Thereafter, the current is cut off when the gate-to-source voltage Vgs of the driving transistor 3B becomes the threshold voltage Vth. In this manner, the voltage corresponding to the threshold voltage Vth of the driving transistor 3B is written in the retentive capacitor 3C. This is the threshold correcting process. Here, the potential of the common ground line 3H is set to cut off the light-emitting element 3D so that the drive current flows into the retentive capacitor 3C, and not into the light-emitting element 3D.

Figure 2F:
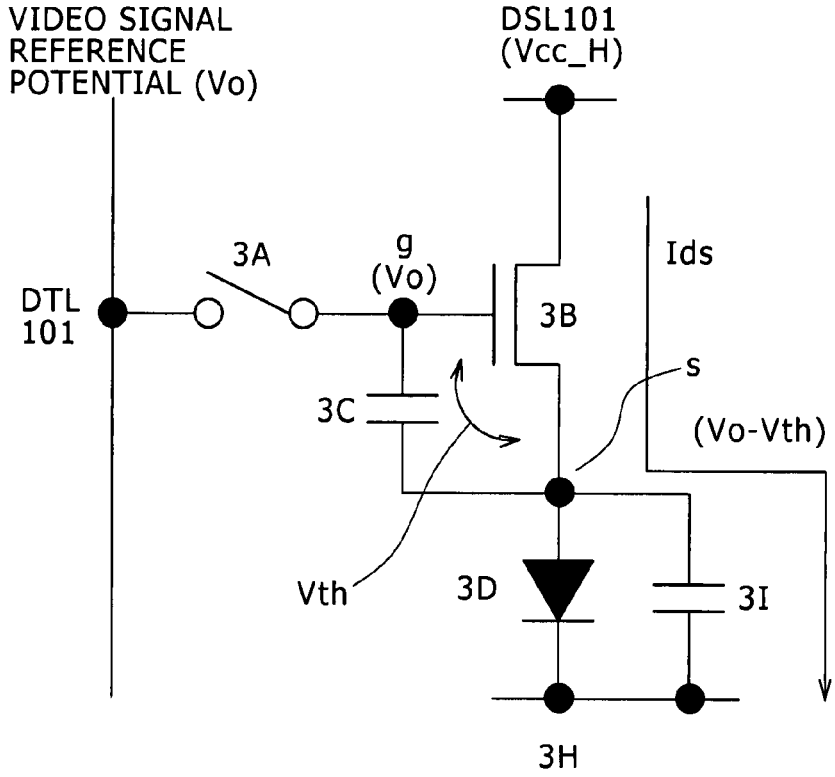

In the period (F), as shown in FIG. 2F, the scanning line WSL101 changes to a lower potential, temporarily turning off the sampling transistor 3A. At this time, the gate g of the driving transistor 3B floats, but there is no drain current Ids because the gate-to-source voltage Vgs is equal to the threshold voltage Vth of the driving transistor 3B and is cut off.

Figure 2G:
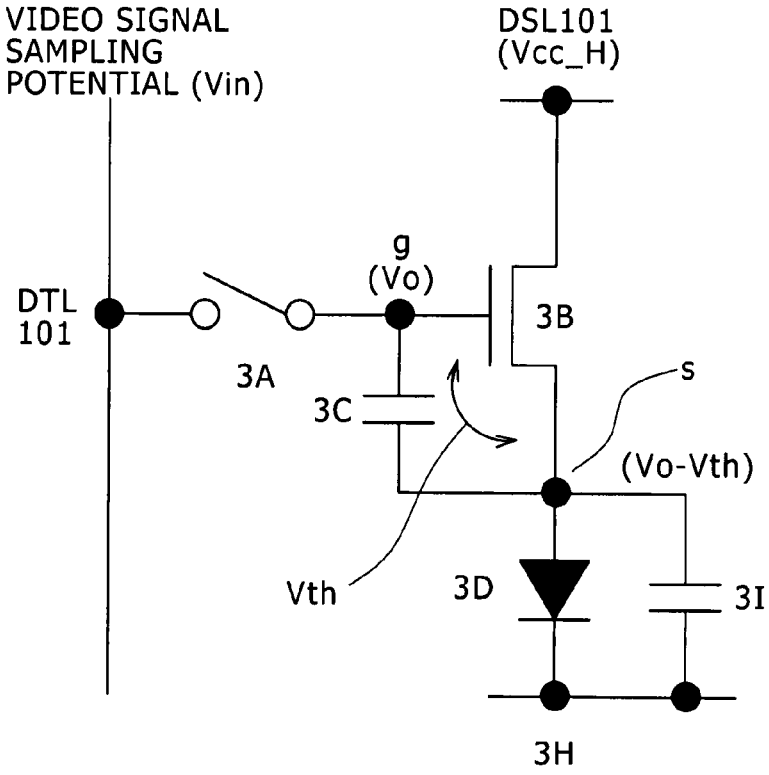

In the period (G), as shown in FIG. 2G, the potential of the video signal line DTL101 changes from the reference potential Vo to the sampling potential (signal potential) Vin, completing the preparation for the next sampling operation and mobility correcting operation.

Figure 2H:
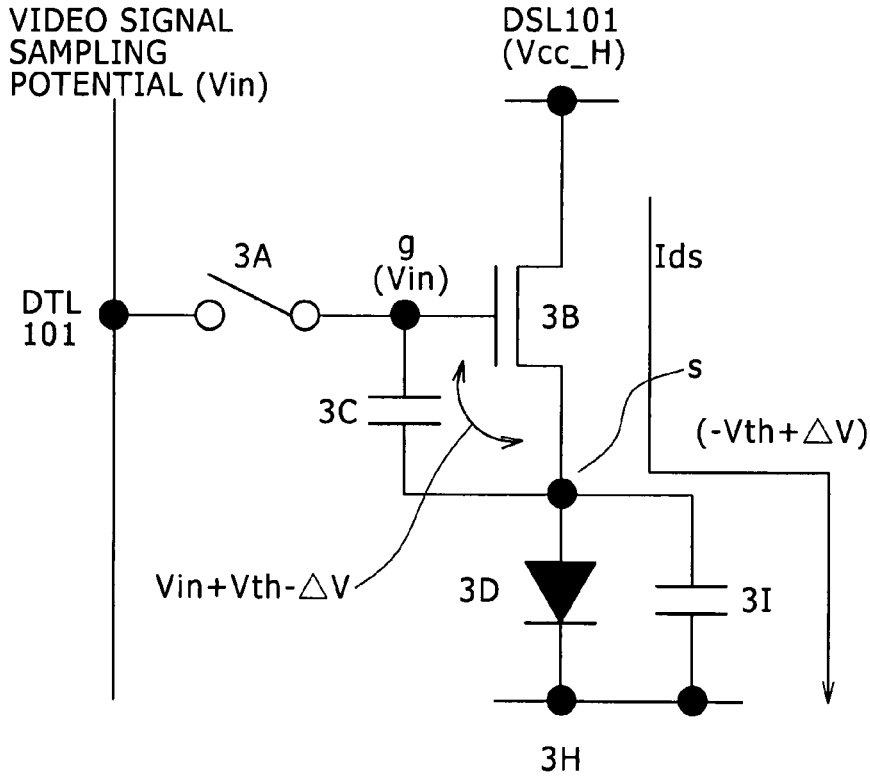

In the sampling period/mobility correcting period (H), as shown in FIG. 2H, the scanning line WSL101 changes to the higher potential, turning on the sampling transistor 3*b*. Therefore, the gate potential Vg of the driving transistor 3B becomes the signal potential Vin. Since the light-emitting element 3D is initially in a cut-off state (high impedance), the drain-to-source current Ids of the driving transistor 3B flows into the light-emitting element capacitor 3I, starting to charge the same. Therefore, the source potential Vs of the driving transistor 3B starts rising until the gate-to-source voltage Vgs of the driving transistor 3B reaches Vin+Vth−ΔV. In this manner, the signal potential Vin is sampled and the corrective quantity ΔV is adjusted at the same time. As Vin is higher, Ids is greater, resulting in a larger absolute value of ΔV. Therefore, the mobility is corrected depending on the light emission luminance level. If Vin is constant, then the absolute value of ΔV is greater as the mobility μ of the driving transistor 3B is greater. Stated otherwise, as the mobility μ is greater, the amount of negative feedback ΔV is greater, so that a variation of the mobility μ of each pixel can be removed.

Figure 2I:
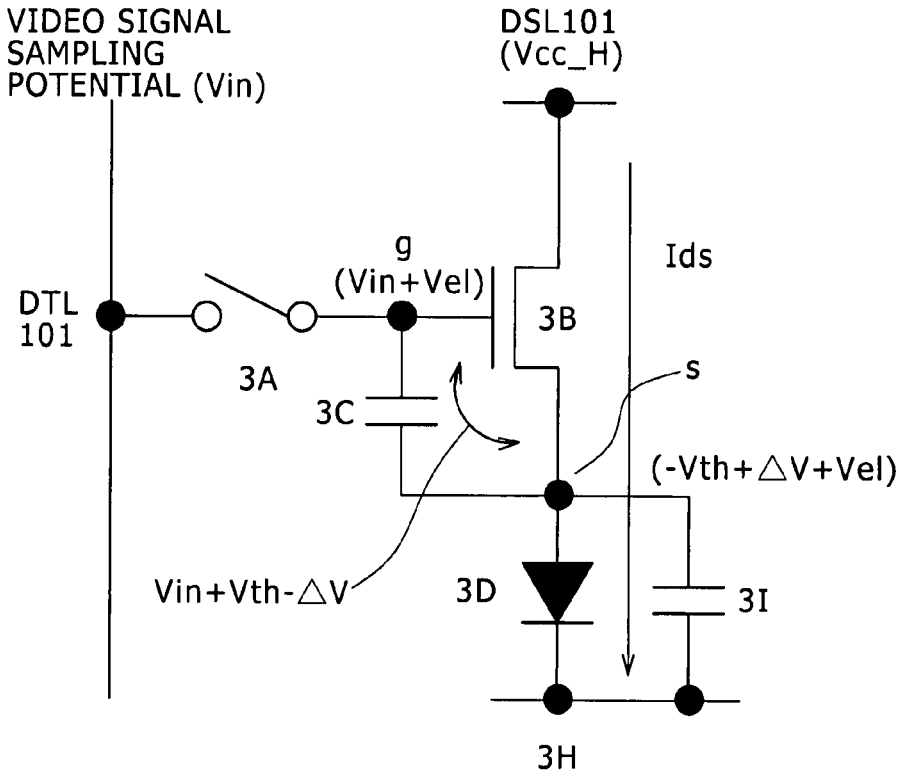

Finally, in the light emission period (I), as shown in FIG. 2I, the scanning line WSI101 changes to the lower potential, turning off the sampling transistor 3A. Therefore, the gate g of the driving transistor 3B is disconnected from the signal line DTL101. Simultaneously, the drain current Ids starts to flow through the light-emitting element 3D. The anode potential of the light-emitting element 3D increases by Vel depending on the drive current Ids. The increase in the anode potential of the light-emitting element 3D means an increase in the source potential Vs of the driving transistor 33. As the source potential Vs of the driving transistor 3B increases, the gate potential Vg of the driving transistor 3B also increases because of the bootstrapping action of the retentive capacitor 3C. The increase Vel in the gate potential Vg is equal to the increase Vel in the source potential Vs. Therefore, the gate-to-source voltage Vgs of the driving transistor 3B is maintained at a constant level of Vin+Vth−ΔV during the light emission period.

Figure 3:
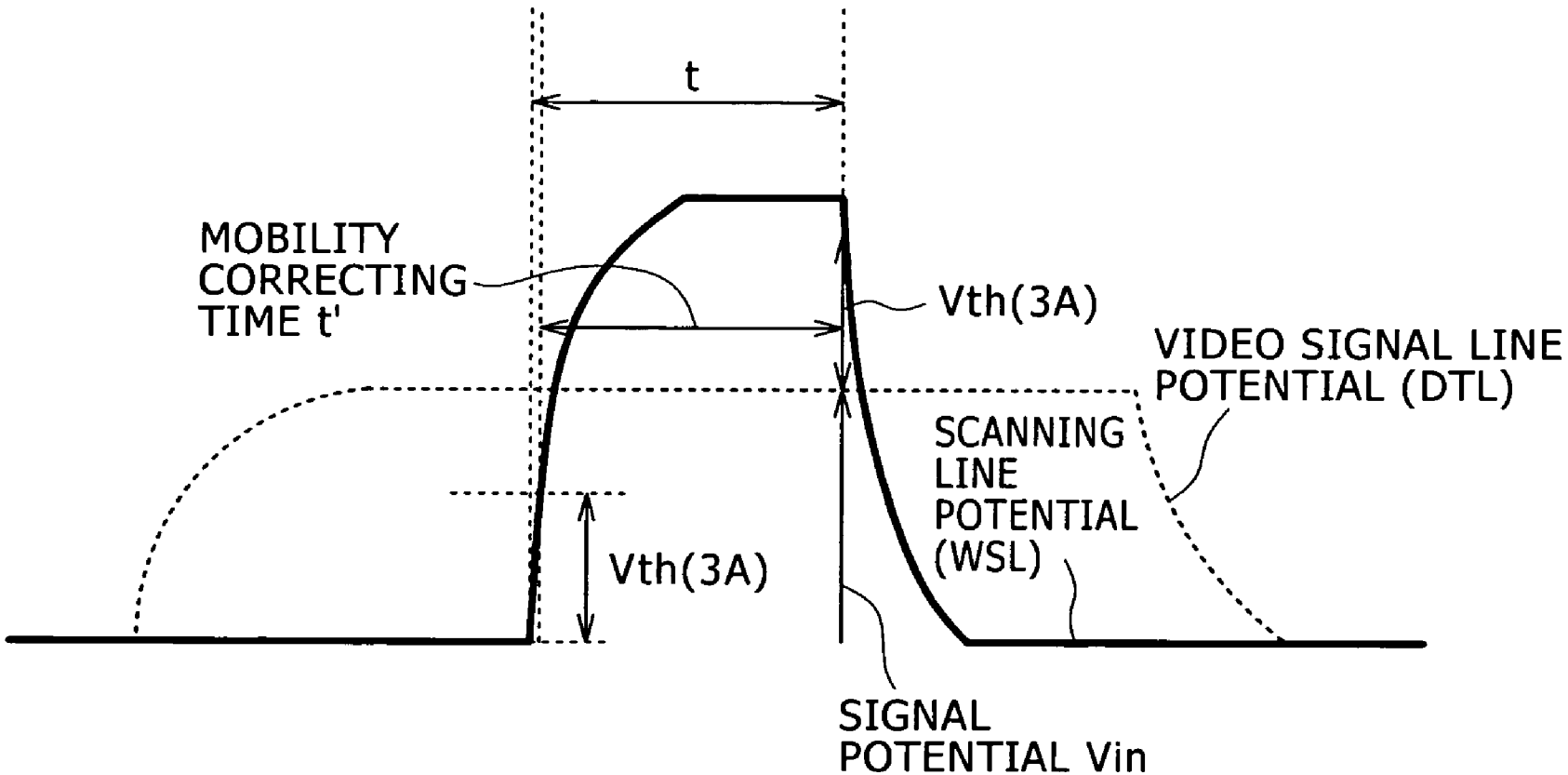
FIG. 3 is a set of graphs illustrative of the operation of the display apparatus according to the embodiment of the present invention.

FIG. 3 is a schematic diagram showing a scanning line potential waveform and a video signal line potential waveform in the sampling period/mobility correcting period (H). The mobility correcting period is determined by a range wherein both the time duration in which the video signal line potential is under the signal potential Vin and a control signal pulse are superposed one on the other. Particularly, since the control signal pulse duration t is precisely determined so as to be present in the time duration in which the video signal line DTL is under the signal potential Vin, the mobility correcting period t' is determined by the control signal pulse duration t. More accurately, the mobility correcting period t' is a time period from the time when the control signal pulse has a positive-going edge to turn on the sampling transistor to the time when the control signal pulse has a negative-going edge to turn off the sampling transistor. As shown in FIG. 3, the on-timing of the sampling transistor is the time when the gate potential (i.e., the scanning line potential) of the sampling transistor 3A exceeds the threshold voltage Vth (3A) of the sampling transistor, compared with the source potential (i.e., the video signal line potential) of the sampling transistor 3A. The off-timing of the sampling transistor is the time when the gate potential of the sampling transistor 3A becomes lower than the threshold voltage Vth (3A) of the sampling transistor, compared with the source potential thereof. Therefore, as shown in FIG. 3, the mobility correcting period t' is mostly equal to the control signal pulse duration t. According to the present invention, the power supply pulse is directly used as the control signal pulse. Since the positive- and negative-going edges of the power supply pulses are highly accurate and do not vary greatly from scanning line to scanning line, any variations of the mobility correcting period are very small, so that the sampling process and the mobility correcting process are performed stably.

Figure 4:
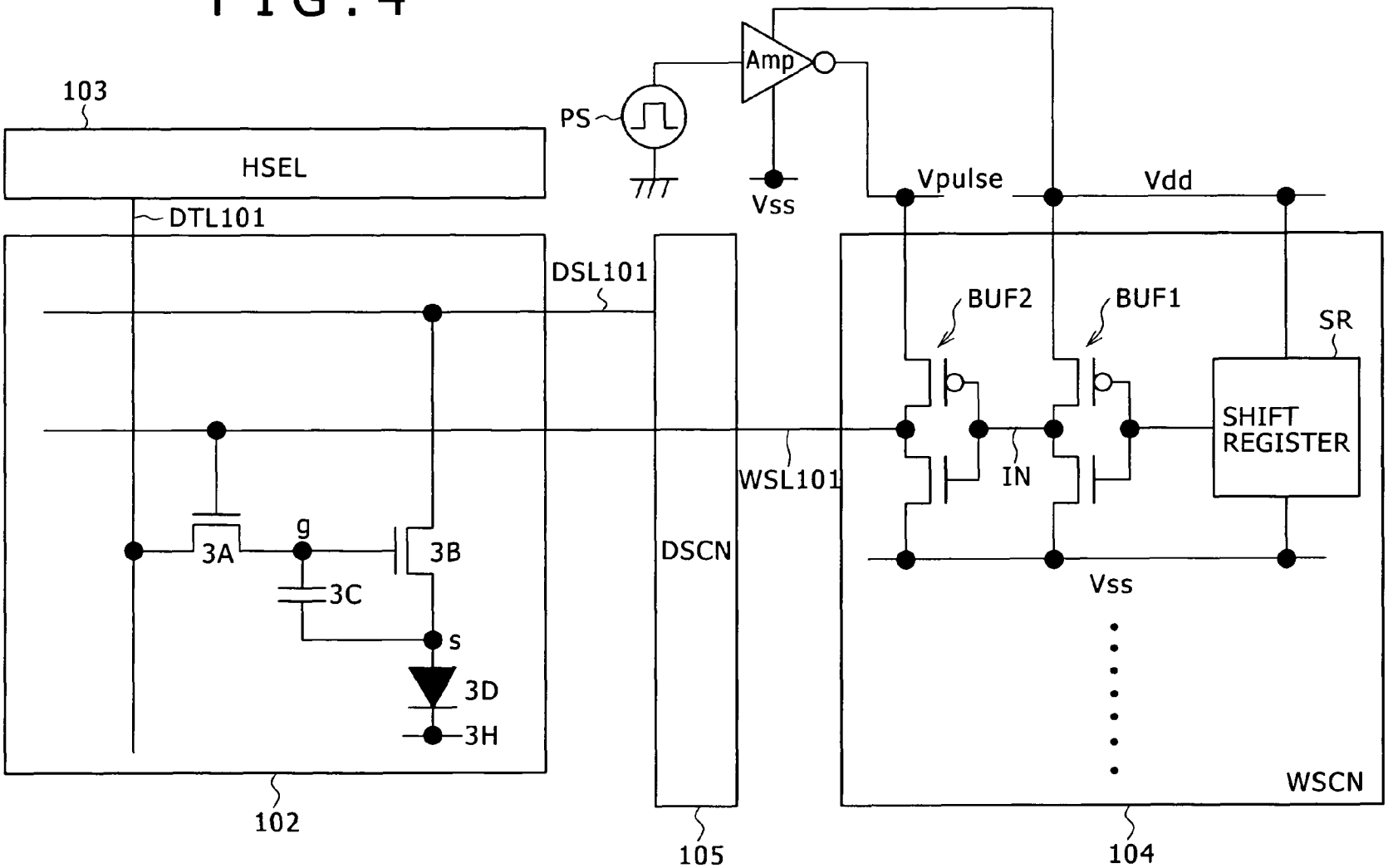
FIG. 4 is a circuit diagram showing specific structural details of a write scanner incorporated in the display apparatus according to the present invention.

FIG. 4 is a circuit diagram showing specific structural details of the write scanner 104 incorporated in the display apparatus according to the present invention. For an easier understanding of the present invention, the circuit diagram shown in FIG. 4 illustrates a stage of the write scanner 104 which corresponds to the scanning line WSL101 as the first low and a pixel 102 connected to the scanning line WSL101. As shown in FIG. 4, the write scanner 104 includes a shift register SR, two output buffers BUF1, BUF2 connected between the shift register SR and the scanning line WSL, and a pulse power supply PS for supplying a train of power supply pulses Vpulse, each having a predetermined pulse duration, to the output buffer BUF2. In the present embodiment, the two output buffers BUF1, BUF2 are connected in cascade between the shift register SR and the scanning line WSL. The train of power supply pulses from the pulse power supply PS is amplified by an amplifier AMP and supplied to the power supply line of the output buffer BUF2. The output buffer BUF2 serves as an actual output buffer, and the output buffer BUF1 serves as an output stage of the shift register SR.

The shift register SR outputs shift pulses IN through the output buffers BUF1 at the respective states according to line sequential scanning. The output buffers BUF2 at the respective stages operate based on the shift pulses IN output from the shift register SR, and output power supply pulses Vpulse supplied from the pulse power supply PSS as control signals to the corresponding scanning lines. According to the present embodiment, the output buffer BUF2 in each stage includes an inverter including a pair of complementary switching devices connected in series between the power supply line and a ground line Vss. Specifically, the complementary switching devices include a P-channel transistor and an N-channel transistor. The pulse power supply PS supplies a train of power supply pulses Vpulse to a power supply line Vdd of the inverter. The power supply pulses Vpulse have a wave height level of Vdd and a reference level of Vss.

Figure 5:
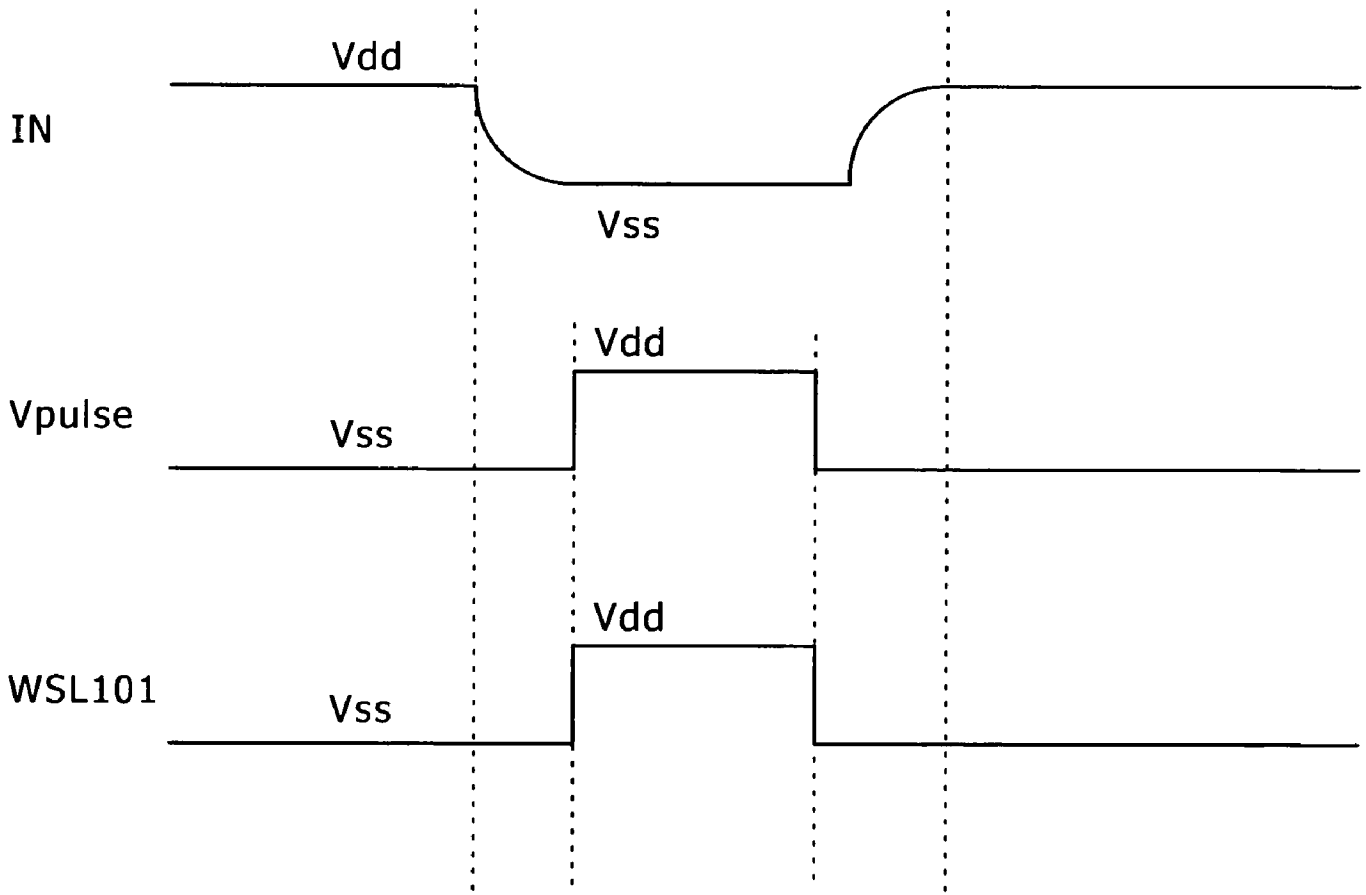
FIG. 5 is a timing chart illustrative of the operation of the write scanner shown in FIG. 4.

FIG. 5 is a timing chart illustrative of the operation of the write scanner 104 shown in FIG. 4. FIG. 5 shows the shift pulse IN, the power supply pulse Vpulse, and potential changes of the scanning line WSL101 along the same time axis. As shown in FIG. 5, the shift pulse IN output from the shift register SR through the buffer BUF1 has blunt positive- and negative-going edges. The shift pulse IN is output in each stage as the shift register SR successively shifts a start pulse. Since the start pulse has its edges blunted while it is being shifted, the shift pulse IN is not of an accurate rectangular waveform, but has blunt positive- and negative-going edges. As the blunt positive- and negative-going edges also differ from stage to stage of the shift register, the waveform of the shift pulse is inaccurate. The power supply pulse Vpulse is generated by the pulse power supply PS and is directly applied to the output buffer BUF. Therefore, the power supply pulse Vpulse is of an accurate rectangular waveform. The output buffer BUF2 operates in response to the shift pulse IN, and extracts the power supply pulse Vpulse and uses it as a control signal for the scanning line WSL101. Accordingly, the potential of the scanning line WSL101 switches between the level of Vss and the level of Vdd at proper timings. The control signal has a constant pulse duration which does not vary from line to line.

Figure 6:
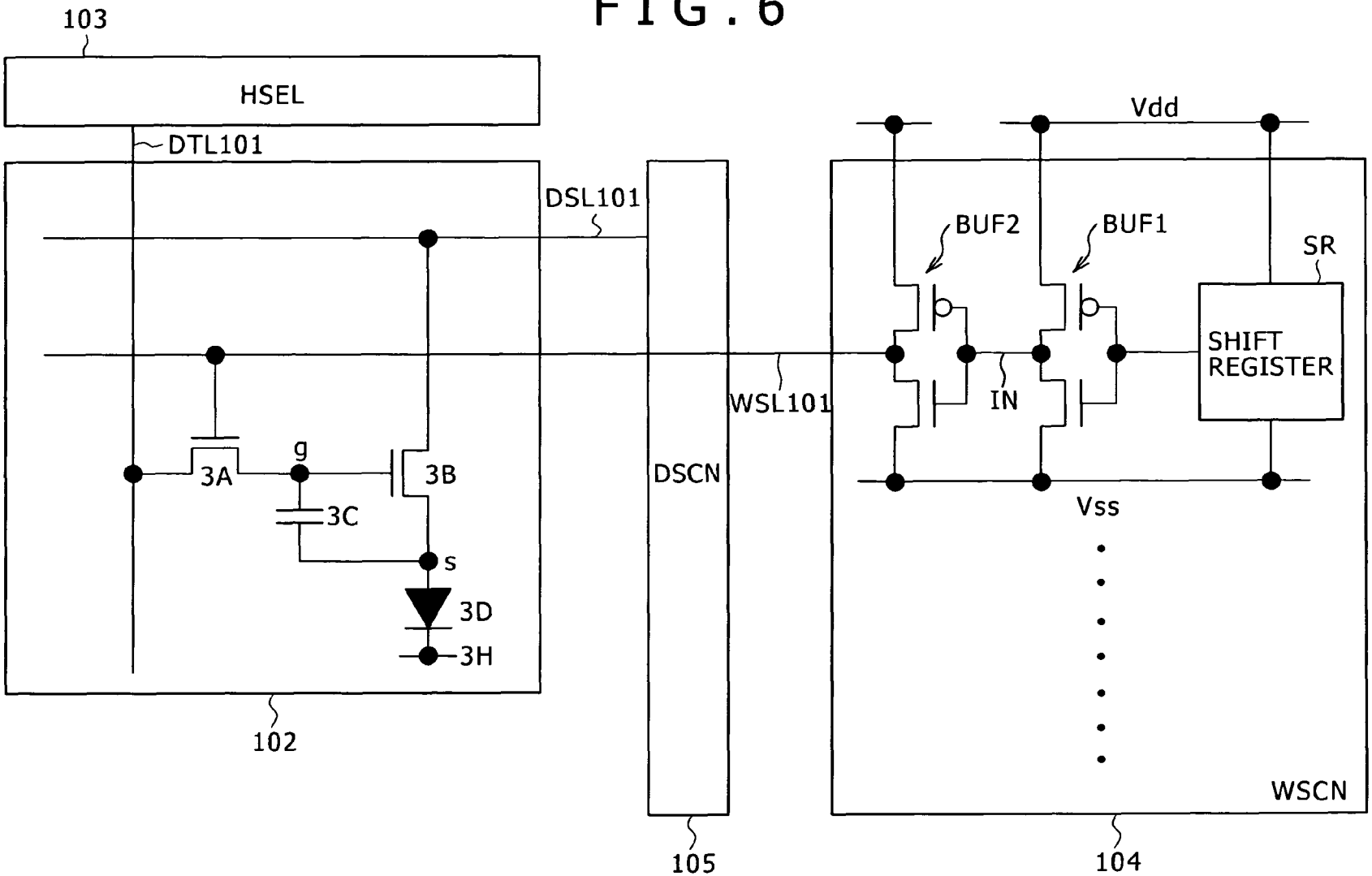
FIG. 6 is a schematic circuit diagram showing a write scanner according to a comparative example.

FIG. 6 is a schematic circuit diagram showing a write scanner 104 according to a comparative example. For an easier understanding of the write scanner 104, those parts of the write scanner 104 according to the comparative example shown in FIG. 6 which correspond to those of the write scanner 104 according to the present invention shown in FIG. 4 are denoted by corresponding reference characters. The write scanner 104 according to the comparative example shown in FIG. 6 differs from the write scanner 104 according to the present invention shown in FIG. 4 in that the output buffer BUF2 of the write scanner 104 according to the comparative example is identical in structure to the preceding output buffer BUF1 and does not employ any power supply pulses. In FIG. 6, the output buffer BUF2 is simply an inverter connected between the power supply line Vdd and the ground line Vss. The power supply line Vdd is maintained under a fixed potential.

Figure 7:
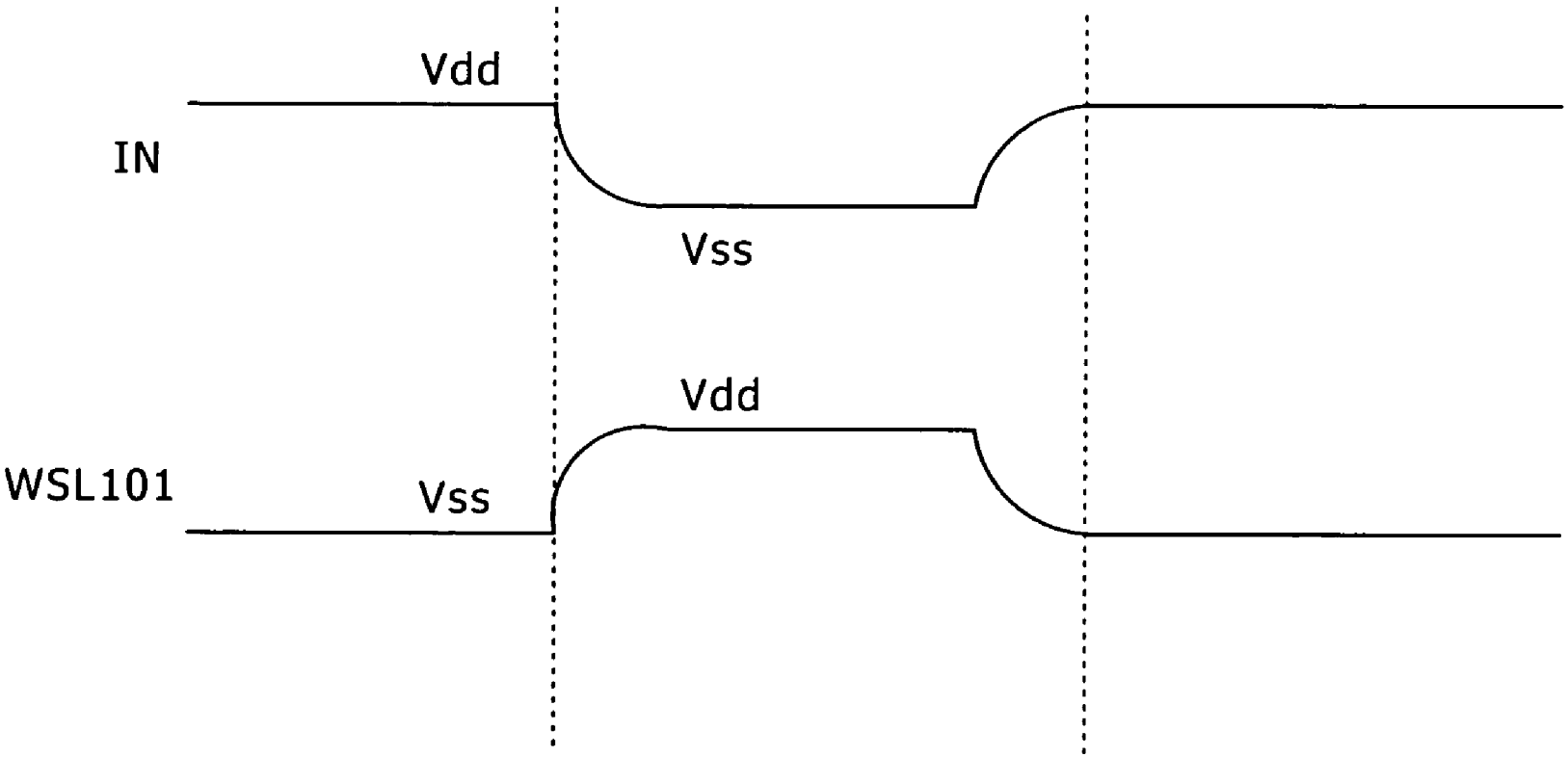
FIG. 7 is a timing chart illustrative of the operation of the write scanner according to the comparative example shown in FIG. 6.

FIG. 7 is a timing chart illustrative of the operation of the write scanner 104 according to the comparative example. FIG. 7 shows the shift pulse IN output from the shift register SR through the output buffer BUF1 and the control signal output from the output buffer BUF2 to the scanning line WSL101 along the same time axis. The output buffer BUF2 includes a simple inverter which inverts the shift pulse IN and outputs the inverted shift pulse IN to the scanning line WSL101. Any variations of the shift pulse IN are thus reflected as variations in the control signal on the scanning line WSL101. Since the write scanner suffers output variations, the mobility correcting process varies from line to line, resulting in luminance irregularities from line to line. With the write scanner according to the present invention, however, since the positive- and negative-going edges of the control signal pulse are determined by the accuracy of the pulse power supply, rather than by the accuracy of the output buffer in the final stage, the positive- and negative-going edges are held in alignment with each other on all lines. Even if the shift pulse supplied from the write scanner is deteriorated, the accuracy of the control signal pulse is determined by the power supply pulse input to the power supply line. Consequently, the mobility correcting time is prevented from varying, and the display images have a good image equality.

Figure 8:
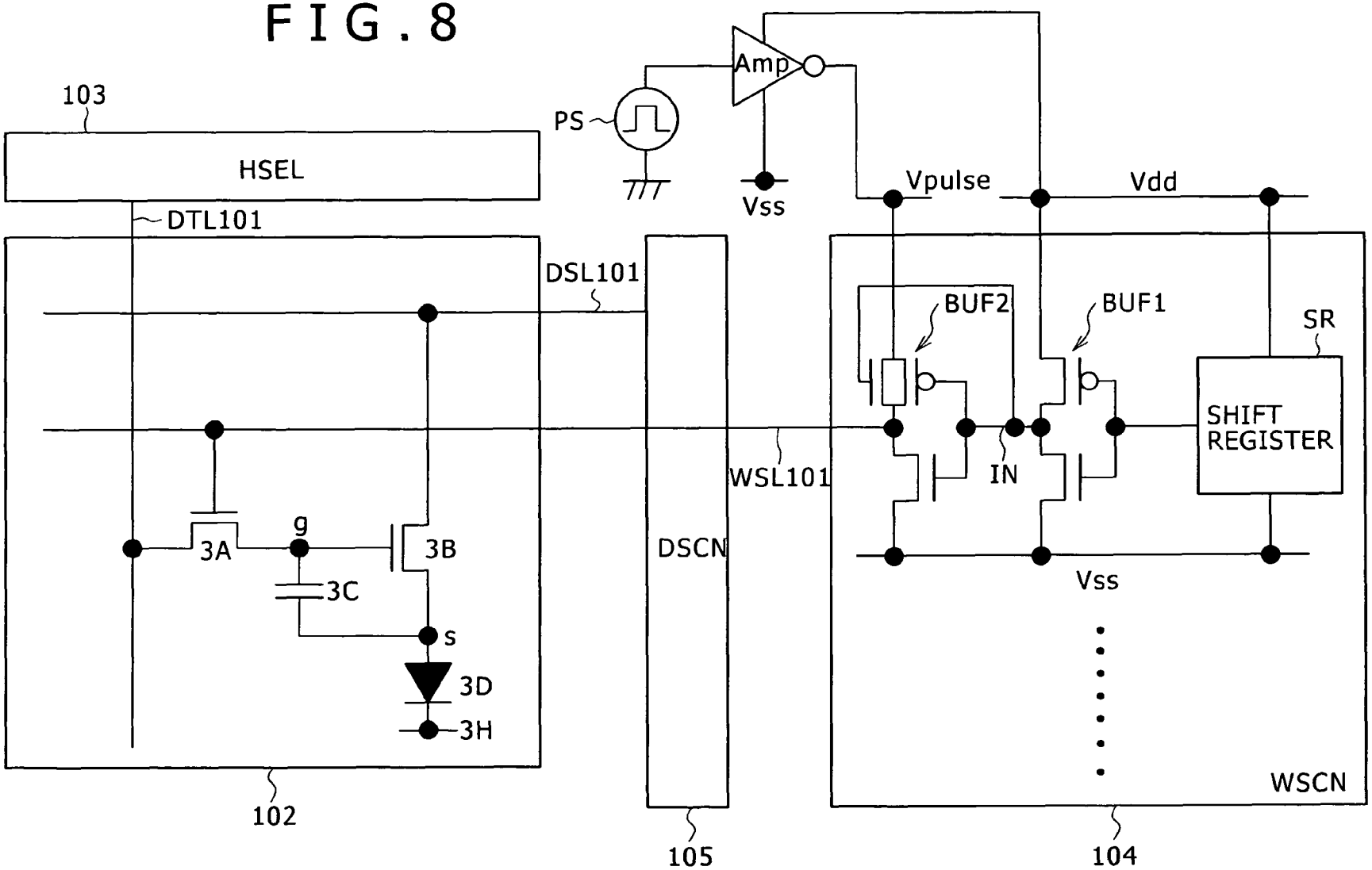
FIG. 8 is a circuit diagram of a write scanner according to another embodiment of the present invention.

FIG. 8 is a circuit diagram of a write scanner 104 according to another embodiment of the present invention. For an easier understanding of the write scanner 104, those parts of the write scanner 104 shown in FIG. 8 which correspond to those of the write scanner 104 shown in FIG. 4 are denoted by corresponding reference characters. The write scanner 104 shown in FIG. 8 differs from the write scanner 104 shown in FIG. 4 as to structural details of the output buffer BUF2. According to the embodiment shown in FIG. 4, the output buffer 2 includes an inverter including a cascaded array of an N-channel transistor and a P-channel transistor. According to the embodiment shown in FIG. 8, the output buffer BUF2 includes an inverter including a transmission gate device instead of the P-channel transistor. Specifically, at least one of the two switching devices of the inverter which is closer to the power supply line is in the form of a transmission gate device. Stated otherwise, the P-channel transistor is replaced with a CMOS device for a lower resistance. The transmission gate device is turned on in response to the shift pulse IN, to extract the power supply pulse Vpulse from the power supply line, and supplies the power supply pulse Vpulse to the scanning line WSL101. The switching device for extracting the power supply pulse Vpulse is in the form of a transmission gate device for a lower resistance to allow the control pulse to change more quickly in level across the positive- and negative-going edges.

It should be understood by those skilled in the art that various modifications, combinations, subcombinations and alterations may occur depending on designs and other factors insofar as they are within the scope of the appended claims or the equivalents thereof.

What is claimed is:

1. A display apparatus comprising:

a pixel array; and a driver configured to drive said pixel array;

wherein said pixel array including rows of scanning lines, columns of signal lines, and a matrix of pixels disposed at crossings of said scanning lines and the signal lines, said driver including a main scanner configured to supply control signals to said scanning lines, said main scanner including a shift register, output buffers connected respectively between said shift register and said scanning lines, and a pulse power supply wherein each of said output buffers comprises an inverter including a pair of complementary switching devices connected in series between a power supply line and a ground line, and said pulse power supply supplies a train of power supply pulses to the power supply line of said inverter.

2. The display apparatus according to claim 1, wherein each of said pixels comprises a light-emitting element, a driving transistor, and a retentive capacitor;

said sampling transistor having a source and a drain, one of which is connected to one of said signal lines and the other to the gate of the driving transistor;

said driving transistor having a source and a drain, one of which is connected to said light-emitting element and the other to one of said feeding lines; and said retentive capacitor being connected between the source and the gate of the driving transistor;

wherein when a signal potential is held in said retentive capacitor, said main scanner renders said sampling transistor conductive to electrically disconnect the gate of said driving transistor from the signal line.

3. The display apparatus according to claim 1, wherein said pixels comprise respective driving transistor and respective retentive capacitors, said driver includes a power supply scanner configured to switch said feeding lines from a first potential to a second potential at a first timing before said sampling transistors sample signal potentials;

said main scanner renders said sampling transistors conductive to apply a reference potential from said signal lines to the gates of said driving transistors at a second timing before said sampling transistors sample signal potentials; and said power supply scanner switches said feeding lines from the second potential to the first potential to hold a voltage corresponding to a threshold voltage of said driving transistors in said retentive capacitors at a third timing after said second timing.

4. The display apparatus according to claim 1, wherein at least one of said switching devices which is closer to said power supply line comprises a transmission gate device.

5. A display apparatus comprising:

a pixel array; and a driver configured to drive said pixel array;

wherein said pixel array including rows of scanning lines, columns of signal lines, and a matrix of pixels disposed at crossings of said scanning lines and the signal lines, and feeding lines associated with respective rows of the pixels, said pixels including respective sampling transistors having respective gates connected to said scanning lines, said driver including a main scanner configured to supply control signals to said scanning lines, said main scanner including a shift register, output buffers connected respectively between said shift register and said scanning lines, and a pulse power supply configured to supply power supply pulses, each having a predetermined pulse duration, to said output buffers, wherein said main scanner outputs power supply pulses supplied from said pulse power supply as the control signals to the respective scanning lines in response to a shift pulse output from said shift register, and wherein each of said output buffers comprises an inverter including a pair of complementary switching devices connected in series between a power supply line and a ground line, and said pulse power supply supplies a train of power supply pulses to the power supply line of said inverter.

6. The display apparatus according to claim 5, wherein at least one of said switching devices which is closer to said power supply line comprises a transmission gate device.

* * * * *